US011407087B2

(12) United States Patent
Kyynäräinen et al.

(10) Patent No.: US 11,407,087 B2
(45) Date of Patent: Aug. 9, 2022

(54) ABRASIVE PRODUCT

(71) Applicant: MIRKA LTD., Jeppo (FI)

(72) Inventors: Niina Kyynäräinen, Salo (FI); Nicolas Schumacher, Inga (FI); Jan Grön, Vöra (FI)

(73) Assignee: MIRKA LTD., Jeppo (FI)

( * ) Notice: Subject to any disclaimer, the term of this patent is extended or adjusted under 35 U.S.C. 154(b) by 819 days.

(21) Appl. No.: 16/090,997

(22) PCT Filed: Apr. 4, 2016

(86) PCT No.: PCT/EP2016/057330
§ 371 (c)(1),
(2) Date: Oct. 3, 2018

(87) PCT Pub. No.: WO2017/174107
PCT Pub. Date: Oct. 12, 2017

(65) Prior Publication Data
US 2019/0111543 A1 Apr. 18, 2019

(51) Int. Cl.
*B24D 11/02* (2006.01)
*D04B 21/02* (2006.01)
*B24D 11/00* (2006.01)

(52) U.S. Cl.
CPC ..... *B24D 11/02* (2013.01); *B24D 11/005* (2013.01); *D04B 21/02* (2013.01); *D10B 2401/10* (2013.01); *D10B 2501/0632* (2013.01)

(58) Field of Classification Search
CPC ..... B24D 11/00; B24D 11/005; B24D 11/02; D04B 21/02; D10B 2501/0632; D10B 2401/10
See application file for complete search history.

(56) References Cited

U.S. PATENT DOCUMENTS 3,703,739 A * 11/1972 Young ..... A47L 11/164 15/230.17
3,845,641 A * 11/1974 Waller ..... D04B 35/00 26/9
4,609,581 A * 9/1986 Ott ..... D04B 21/165 428/100
4,677,011 A * 6/1987 Matsuda ..... A44B 18/0034 428/88

(Continued)

FOREIGN PATENT DOCUMENTS

CN 1091074 A1 8/1994
CN 101400481 A1 4/2009

(Continued)

OTHER PUBLICATIONS

Second Office Action for Chinese Application No. 201680086247.7, dated Dec. 1, 2020.

(Continued)

*Primary Examiner* — Joseph J Hail
*Assistant Examiner* — Arman Milanian
(74) *Attorney, Agent, or Firm* — Wolf, Greenfield & Sacks, P.C.

(57) ABSTRACT

Provided is a flexible abrasive product (1) comprising a knitted cloth (2) on a first side of the flexible abrasive product (1), grinding agents (50) applied on a second side of the flexible abrasive product (1) facing the first side, and a plurality of loops (71) protruding from the cloth (2) and from the first side, each loop (71) being formed by a pair of bottom-half arcs (76) connected by a protruding head (77) and the loops (71) being arranged in rows extending in the wale direction (W) of the cloth (2), wherein the bottom-half arcs (76) are interlaced in the cloth (2), and the protruding heads (77) of the loops (71) are interconnected with one another outside of the cloth (2) so as to form rows (73) of interconnected loops (71), which rows (73) extend in the wale direction (W) of the cloth (2).

20 Claims, 5 Drawing Sheets

(56) References Cited

U.S. PATENT DOCUMENTS

| | | | | |
|---|---|---|---|---|
| 4,858,447 | A * | 8/1989 | Matsuda | D04B 21/02 66/193 |
| 5,503,892 | A * | 4/1996 | Callaway | D04B 21/04 428/92 |
| 6,024,634 | A | 2/2000 | Höglund et al. | |
| 7,235,114 | B1 | 6/2007 | Minick et al. | |
| 8,206,202 | B2 * | 6/2012 | Hoglund | B24D 18/00 451/533 |
| 2015/0343605 | A1 | 12/2015 | Höglund et al. | |

FOREIGN PATENT DOCUMENTS

| | | | |
|---|---|---|---|
| CN | 104797380 | A | 7/2015 |
| DE | 1 577 598 | A1 | 9/1969 |
| EP | 0 265 739 | A1 | 5/1988 |
| EP | 0 645 486 | A1 | 3/1995 |
| EP | 1 733 844 | A1 | 12/2006 |
| FR | 2 865 675 | A1 | 8/2005 |
| GB | 1 999 940 | A | 7/1970 |
| WO | WO 2007/109390 | A2 | 9/2007 |
| WO | WO 2014/037034 | A1 | 3/2014 |

OTHER PUBLICATIONS

International Search Report and Written Opinion for International Application No. PCT/EP2016/057330 dated Feb. 8, 2017.
International Preliminary Report on Patentability for International Application No. PCT/EP2016/057330 dated Oct. 18, 2018.

* cited by examiner

3

ABRASIVE PRODUCT

RELATED APPLICATIONS

This application is a national stage filing under 35 U.S.C. § 371 of international application number PCT/EP2016/057330, filed Apr. 4, 2016, which is herein incorporated by reference in its entirety.

FIELD OF THE INVENTION

The present invention relates to flexible abrasive products comprising a knitted cloth.

TECHNICAL BACKGROUND OF THE INVENTION

A common problem with regard to flexible abrasive products is how to reliably attach them to the corresponding support on grinding machines. Alternative approaches have been devised for solving this problem. These include, for instance, the use of pressure sensitive adhesives (PSA) and hook and loop fastening systems like the Velcro®-system.

The PSA system is well suited for sanding flat surfaces and where the stresses are low. However, the PSA system is moisture sensitive, softens when heated by friction and is comparatively difficult to handle, which renders it less preferable for several applications. Moreover, the application of the adhesive requires a separate manufacturing step and is not favorable from a sustainability point of view.

Therefore, nowadays, hook and loop fastening systems have proven the method of choice for many professional applications. In this regard, the "hooks" are commonly arranged at the machine side (by means of a suitable backing pad or grip surface), while the loops have to be provided by the abrasive product.

To this end, loops may, for instance, be integrated in a separate laminate layer of the abrasive article. This approach is commonly pursued for flexible abrasives which rely on a film as a backing material.

Another group of abrasives relies on fabrics or cloths as backing material. In terms of an attachment via a hook and loop fasting system this has the distinct advantage that the loops can be readily integrated in the—commonly knitted—base material (c.f. EP 0 779 851, for instance). By forming loops in the cloth, it is possible to integrally provide the abrasive product with means for engagement, which is particularly economic. As exemplified in EP 0 779 851, such loops can be formed in form of the underlappings of the knitting structures, which may be pulled out of the cloth within the course of a raising process.

SUMMARY

Independent from whether the loops are provided by means of a laminate layer or as integral parts of a base fabric, both solutions have in common, however, that they still suffer from a number of shortcomings.

For instance, the attachment is prone to fail due to the fact that not enough loops are available for establishing a connection to the machine. In particular, this is the case if the abrasive product as such is required to have a somewhat open structure to improve the dust removal. Moreover, the loops tend to wear out and eventually break before the lifetime of the abrasive has come to an end. In addition, the forces that can be transmitted are limited.

In return, this also impacts on the lifetime of the backing pad on the machine side, since fewer hooks have to support higher forces.

Another problem is that the loops are prone to lay down when the product is rolled-up or stacked in boxes during manufacturing and shipping. This has the immediate consequence that a considerable proportion of the loops will not be "available" for establishing a connection in the first place.

Accordingly, it is an object of the present invention to conceive a flexible product, which addresses the above disadvantages and provides an improved engagement to the hook-part in a hook-and-loop fastening system.

According to one aspect of the present invention, a flexible abrasive product comprises a knitted cloth on a first side of the flexible abrasive product, grinding agents applied on a second side of the flexible abrasive product facing the first side, and a plurality of loops protruding from the cloth and from the first side, wherein each loop is formed by a pair of bottom-half arcs connected by a protruding head and the loops being arranged in rows extending in the wale direction of the cloth; wherein the bottom-half arcs are interlaced in the cloth, and the protruding heads of the loops are interconnected with one another outside of the cloth so as to form rows of interconnected loops which rows extend in the wale direction of the cloth.

Since the loops are interconnected, they are less prone to lay down, which means that they are more readily available for establishing a connection to hooks serving as counterparts in a hook and loop fastening system. Also storing the product in stacks or in rolls becomes less critical.

Further, the loops will not bent back and forth as much as single loops during an oscillating movement of the sanding machine do, so that they do not wear out as quickly and the lifetime of the product is increased.

Still, the loop structure is highly open and allows for an effective air and dust removal.

Furthermore, the interconnected loops also yield a cushioning effect which is favorable for many sanding applications. The level of cushioning can be adjusted by the loop height, yarn thickness and length, and stitch density. As another benefit, a variable water take up capacity during wet-sanding is achieved. Moreover, it is worth noticing that compared to conventional soft products, which commonly rely on foams (e.g. PU foams) for achieving a cushioning effect, the above flexible abrasive product is more sustainable and environmentally friendly (due to reduced use of adhesives and elastomers).

Finally, the product is relatively easy to manufacture since the cloth and the loops can still be manufactured simultaneously by knitting, i.e. in one process step. Moreover, the relevant properties of the product (such as the softness, the strength or the permeability for dust) can be readily adjusted by varying the thickness and stiffness of the cloth and the density of the loops per $cm^2$.

Preferably, the bottom-half arcs of each loop are spaced by at least one stitch-row of the cloth and, more preferably, by two stitch rows of the cloth.

This means, in other words, that the loops are held in a predominantly open configuration in a shape which resembles a V- or U-shape. This configuration has the advantage that the loops are more readily available for the "hook-part" of a hook and loop fastening system. Moreover, the loops are less prone to lay down and the resulting structure is more resistant to shear forces during sanding. In addition, this enhances the cushioning effect.

It is preferable that the protruding heads alternatingly span one stitch row in the course direction of the cloth.

By that, the loops which are arranged in the course direction may overlap one another in the sense that a bottom-half arc of one loop is arranged between the bottom-half arcs of the neighboring loops.

This has the benefit of an enhanced cushioning effect and a better resistance of the fastening structure vis-à-vis shear forces occurring during sanding.

Preferably, the protruding heads of the loops are interconnected by being knitted to one another in the wale direction of the cloth, in particular, by chaining protruding heads which succeed one another in the wale direction of the cloth.

This way of interconnecting the loops provides for a very efficient way of achieving the desired configurational stability of the loops without hampering the dust-permeability of the product and without too much increasing the complexity for manufacturing. In addition, the chaining may readily be combined with various different binding patterns for the cloth and thus allows for an increased flexibility during manufacturing.

According to a preferred embodiment, the protruding heads are respectively interconnected by threading the protruding head of one loop through the protruding head of another loop which precedes the one loop in the wale direction of the cloth.

This constitutes a very effective way of interconnecting the loops outside of the cloth. Moreover, the loops are readily prevented from laying down since they are mutually interconnected in the wale direction, of the cloth. In addition this way of interconnecting the loops ensures that the hooks or the like of an associate fastening system can readily enter the product and engage with the loops.

If combined with loops having their bottom-half arcs spaced by at least one stitch-row of the cloth, this provides the synergistic effect that the top ends of the loops are additionally prevented from "sliding down" the corresponding connecting loop (towards the cloth), since the connecting loop is held predominately open. Accordingly, this further contributes to a layer of loops which is very stable and very unlikely to collapse. In addition, the loops are more readily able to "recover" after having been pressed onto the cloth during manufacturing or shipping.

Preferably, the protruding head of each loop comprises two leg portions respectively connecting to the bottom half arcs and a top arc connecting the two leg portions, wherein the leg portions extend in a direction away from the cloth and away from the first side, the top arc is arranged essentially horizontally to the cloth, and the protruding heads of the loops are connected to one another at their top arcs.

Apart from dimensionally stable loops, this has the benefit that the loops can readily establish a connection to hooks or the like due to the loop portions which extend essentially parallel to the surface of the cloth.

Preferably the protruding heads have contour lengths of 4 mm to 500 mm, and, more preferably, 6 mm to 80 mm.

This ensures that the loops are long enough for being readily available for attaching to corresponding attachment means like hooks and for interconnecting the loops in the wale direction. At the same time, they are not too long so that they would hamper a reliable force transduction from the grinding machine.

Preferably, the loops are formed by loop yarns which are interlaced in the cloth.

On the one hand, this offers the advantage that the loop yarns may be chosen such that they suit the respective application. One the other hand, the loops can be formed independently of the cloth meaning that there are more degrees of freedom concerning the knitting pattern for the cloth.

Alternatively, the loops may also be formed by the yarns of the cloth, which has the advantage that no additional yarn species has to be supplied when manufacturing the cloth, thereby rendering the manufacturing process very economical.

Preferably, the loop yarns are man-made or natural fibers comprising flat yarns, texturized yarns, magnetizable, metallic or hydrophilic yarns and/or combinations thereof.

Using metallic or magnetizable loop yarns makes it possible to use magnetic forces for attaching the abrasive product to a grinding machine. If, for instance, the grip surface of a grinding machine is provided with a magnet (either a permanent magnet or an electromagnet), the abrasive product comprising magnetizable loop yarns can be held in place on the grinding machine by magnetic forces. This magnetic attachment may be complemented, of course, by a mechanic attachment involving the aforementioned loop-and-hook-attachment system. An attachment by means of magnetic forces has the advantage that it is quasi maintenance free as it does not lead to any wear of the abrasive product or the grip surface of the grinding machine.

By using texturized and/or hydrophilic yarns, a product can be provided that facilitates wet sanding processes, since the product is able to more readily take up water or other aqueous solutions.

Preferably, the loop yarns are warp- or weft-knitted into the cloth and, more preferably, in the form of an atlas, tricot, pillar, or cord binding or combinations thereof.

Interlacing the loop yarns by means of warp-knitting or weft-knitting offers a very effective and mechanically stable way of integrating the loop yarns in one single working process. The atlas, pillar, cord, or tricot bindings, in particular, offer an efficient way to optimally integrate the loops into the cloth without considerably limiting the degrees of freedom when designing the cloth.

Of note, the aforementioned bindings refer to the interlacing of the loops into the cloth and not to the way how they are interconnected outside of the cloth.

Preferably, the loop yarns are monofilament yarns.

Compared to multifilament yarns, which tend to be more bulky than monofilament yarns, the usage of monofilament yarns for the loops has the advantage that the knitting pattern of the cloth is affected as little as possible if the loop yarns are worked into the cloth. This may bring about the benefit of a largely homogenous (or even) appearance of the cloth which is beneficial for many sanding applications.

In this regard, the loop yarns preferably have a yarn count between 5 to 200 dtex and more preferably between 10 to 100 dtex, and even more preferably between 20 to 50 dtex.

Preferably, the cloth is warp- or weft-knitted, preferably in the form of an atlas, tricot or cord binding.

Thereby, atlas- or cord structures are suited for combining a comparatively regular and even appearance of the cloth with the option to introduce loop yarns and openings into the cloth.

Preferably, the cloth further comprises a plurality of regularly arranged openings in, the form of through holes.

Due to the through holes, sanding dust and other particles can easily penetrate through the abrasive product. This considerably facilitates the removal of dust from the sanding area, where the work piece is machined and prevents the clogging of the abrasive product. In turn, this increases the lifetime of the abrasive product and prevents an excessive heating of the sanding surface, which ensures a high quality sanding finish.

Preferably, the form and the arrangement of the openings are symmetric with respect to the wale direction of the textile fabric.

This has the advantage that the cloth, which forms the basis for the abrasive particles is very regular as such. By consequence the abrasive area is very regular and a high quality surface finish can be obtained during sanding.

Preferably, the openings are arranged in lines perpendicular to the wale direction of the cloth, wherein the openings are regularly spaced in the line direction and the lines are offset from one another with respect to the position of the openings.

The regular spacing of the openings in the line direction ensures that an even sanding surface is achieved in the width direction of the sanding area. If the lines are offset from one another with respect to the position of the openings, the openings are not arranged in uniform rows along the wale direction. This may further diminish the occurrence of stripes on the sanded surface.

Thereby, it is further preferred that subsequent lines (i.e. lines that follow one another in the wale direction) are offset from one another with respect to the position of the openings.

In this regard, it is furthermore preferable that the offset between subsequent lines is such that the openings of every second line align in the wale direction.

If seen in the machine direction, the latter means, with, other words, that a region coated with abrasives between two adjacent openings in one line is followed by an opening of the next line which is again followed by a region coated with abrasives of the second next line and so forth. Accordingly, this arrangement effectively suppresses the formation of stripes in the finished product if used for unidirectional sanding machines.

Preferably, the flexible abrasive product further comprises a soft or pliable intermediate layer which is arranged between the grinding agents and the cloth. Preferably the intermediate layer is preferably formed of a non-woven material, a foam material, a fabric material or combinations thereof.

With the soft intermediate layer, the cushioning effect of the product can be further promoted. Moreover, such an intermediate layer may also be beneficial for wet sanding applications, since it may store water or aqueous solutions and release them over time during sanding.

Preferably, the product further comprises filler yarns protruding from the first side, wherein the filler yarns are texturized or hydrophilic yarns and protrude in the form of loops or thread ends.

By providing the filler yarns, the water retaining properties of the product as regards wet sanding applications can be further expanded. Further, the filler yarns may also promote the cushioning effect.

According to another aspect of the present invention, a flexible interface for abrasives is provided, which comprises a knitted cloth on a first side of the flexible interface, attachment means arranged on a second side of the flexible interface facing the first side, the attachment means being configured to be engageable to abrasive products. The flexible interface further comprises a plurality of loops protruding from the first surface and from the cloth, each loop being formed by a pair of bottom-half arcs connected by a protruding head and the loops being arranged in rows extending in the wale direction of the cloth, wherein the bottom-half arcs are interlaced in the cloth, and the protruding heads of the loops are interconnected with one another outside of the cloth so as to form rows of interconnected loops, which rows extend in the wale direction of the cloth.

"Being configured to be engageable to abrasive products" might involve the provision of engagement means such as hooks (for hook and loop fastening systems) or other complementary fastening systems or PSA systems.

With the flexible interface, the advantageous properties of interconnected loops (i.e. the cushioning effect, the more reliable engagement to grinding machines, the permeability for dust and so on) may be transferred to ordinary grinding products.

According to a preferred embodiment, the attachment means are hooks, mushrooms or knobs which are engageable to the loop-part of a hook and loop fastening system. With that, the flexible interface is compatible to a wide variety of grinding products, like, for instance, the ones which are described in EP 0 779 851.

The preferred features listed above in connection with the abrasive product may also be applied for the flexible interface, where they yield equivalent effects.

BRIEF DESCRIPTION OF THE DRAWINGS

The invention may be better understood by reference to the following specification disclosed in the further embodiments thereof and taken in conjunction with the following accompanying figures.

The description and the accompanying drawings are to be construed by way of example and not of limitation.

DETAILED DESCRIPTION OF THE INVENTION

In the following, the invention is described in detail with reference to the drawings.

Figure 1A:
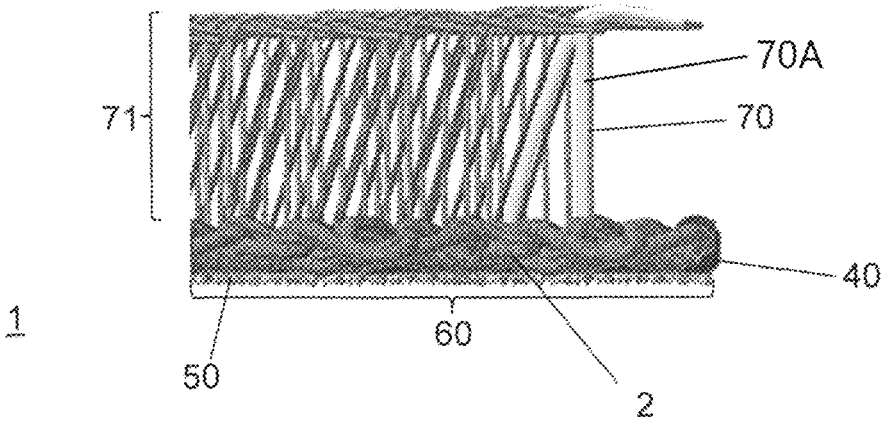
FIGS. 1A to 1D are schematic illustrations of an abrasive product according to a first embodiment.
Figure 1B:
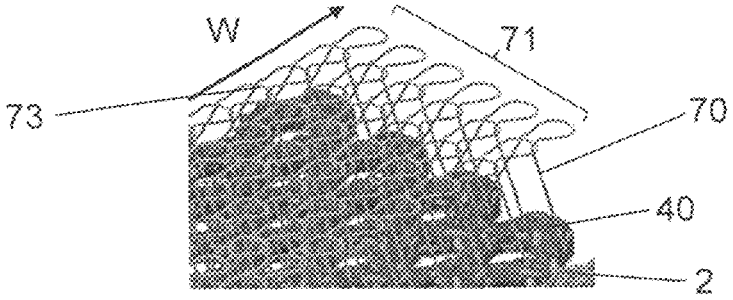
Figure 1C:
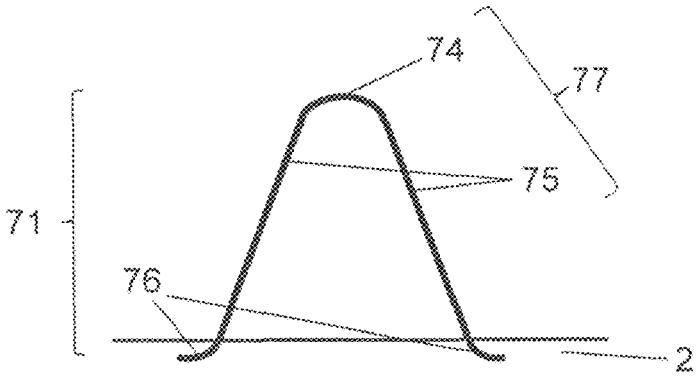

FIGS. 1A and 1B are schematic representations of a flexible abrasive product 1 according to a first embodiment. The abrasive product 1 comprises a cloth 2 which constitutes the base layer of the abrasive product 1. The cloth 2 is a knitted textile fabric which is formed of knitted yarns 20 and can be produced on a textile producing machine by warp-knitting or weft-knitting, for instance.

On a first side of the cloth 2 (a first side of the abrasive product), a plurality of loops 71 are formed which protrude from the knitted cloth 2. The loops 71 are formed of loop yarns 70.

On a second side of the abrasive product, grinding agents or abrasive particles 50 are applied so as to form an abrasive area 60. The abrasive particles 50 are applied/adhered to the second side of the cloth 2 which faces the first side. The fixation of the abrasive particles 50 can be promoted by a coating 40. Optionally, the abrasive particles 50 can be applied with a suitable binding system.

As indicated in the cross section of FIG. 1, the abrasive area 60 in this example is coherent throughout the product 1, wherein the abrasives 50 are evenly distributed over the cloth 2. However, the abrasive area may also be incoherent, e.g., in the form of isolated spots or islands of abrasive particles.

The loops 71 are arranged in rows in the wale direction W of the cloth 2. Further, as can be seen in the Figures, the loops 71 are interconnected with one another in a plane essentially parallel to and spaced apart from the cloth 2. In other words, the protruding loops 71 are interconnected outside the cloth 2.

Accordingly, the loops 71 form rows 73 of interconnected loops, which rows 73 also extend in the wale direction W of the cloth 2 (and are "elevated" with respect to the cloth 2).

Figure 2A:
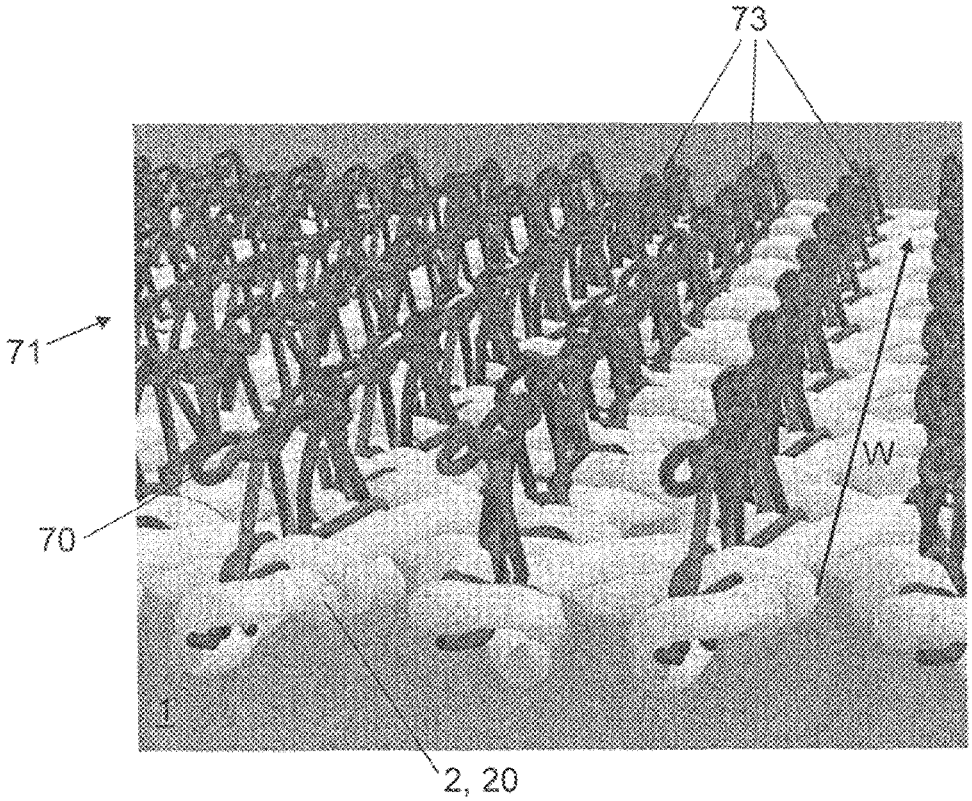
FIG. 2 shows an example for a knitting pattern for the abrasive product according to the first embodiment.
Figure 2B:
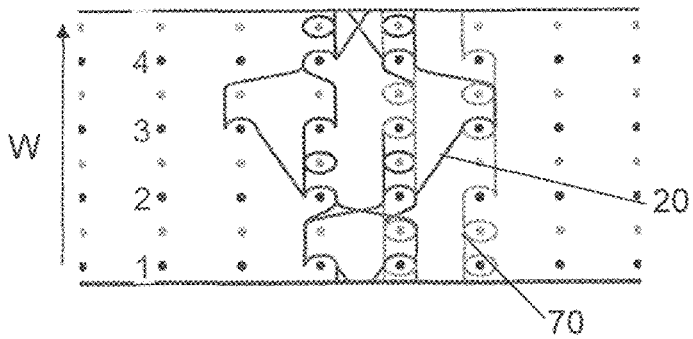

In the example which is shown in FIG. 2B, the loops 71 are only connected in the wale direction W. There is no interconnection between the individual rows 73.

Referring to FIG. 10, the relevant parts of the loops 71 are defined as follows: each loop comprises a pair of bottom-half arcs 76 connected by a protruding head 77. With the bottom-half arcs 76, the loops are connected to the cloth 2 in the sense that these portions of the loops 71 are interlaced in the cloth 2. The protruding head 77 is the portion of the loop 71 which actually protrudes from the cloth 2, i.e., is arranged outside of the cloth 2. The protruding head 77 of the loop 71, in return, can be regarded as being formed by a pair of leg portions 75, which respectively connect to the bottom-half arcs 76, and a top arc 74 which connects the two leg portions 75.

In the example according to FIGS. 1A and 1B, the interconnection of the loops 71 is achieved by chaining the protruding heads 77 of the loops 71 which succeed one another in the wale direction W of the cloth 2 by threading the protruding head 77 of one loop 71 through the protruding head 77 of the preceding loop 71. However, other techniques—in particular, knitting techniques—may also be used f interconnecting the loops 71.

Figure 1D:
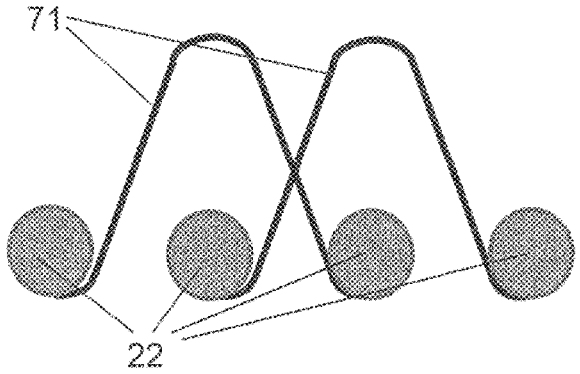

As can be seen from FIG. 1D, the bottom-half arcs 76 of each loop 71 are spaced apart from one another in the course direction of the cloth (which is perpendicular to the wale direction W). This has the effect that the loops are held "open", with the leg portions 75 being inclined against one another as they extend from the surface of the cloth 2. Hence, if the product is regarded in the wale direction W, the loops 71 have a V-shape or U-shape like configuration which narrows towards the top arcs 74. The inclination or tilting of the leg portions 75 (with respect to a normal line onto the cloth) can be adjusted by varying the spacing between the bottom-half arcs 76 and the contour length of protruding heads 77. The protruding heads 77 have a contour length of 4 mm to 500 mm, preferably 6 mm to 80 mm and most preferably between 10 mm and 20 mm.

Due to the tilting of the leg portions 75 in counter directions, the product 1 becomes more resistant against shear forces when attached to a grinding machine. In addition, such a configuration allows hooks, mushrooms or other types of griping means to more readily interlock with the loop yarns 70 and consequently hold the product 1 in place.

Another effect is that the loops 71 can be kept relatively open which to some extend prevents that upon chaining the loops to one another the top arc or noose of one loop "slides down" the leg portions of the loop it is chained to. By consequence, this further promotes the dimensional stability of the loops 71 because they are less likely to collapse under mechanical impact and pressure. Moreover, the top arcs 74 are arranged essentially horizontally with respect to the cloth 2.

Preferably, the bottom-half arcs 76 of each loop are at least spaced by one stitch-row 22 of the cloth 2 and more preferably by two stitch-rows 22 of the cloth (c.f. FIG. 1D). The latter, in other words, means that the loop 71 spans over one stitch row 22 (c.f. FIG. 1D). In that case, it is particularly preferable if the loops 71 (or their protruding heads 77) alternatingly span one stitch-row 22 in the course direction (c.f. FIG. 1D).

In this regard, a stitch row 22 or wale is a stitch wale of stitches which proceeds over the length of the knitted fabric (c.f. ISO 4921:2000, 3.3.1).

Although the loops 71 may also be formed by pulling under- or overlappings out of the cloth 2, it is preferable that the loops are formed by loop yarns 70 which are interlaced in the cloth 2.

Exemplarily, the product 1 as described in FIG. 1 can be manufactured by using a double needle bar knitting machine for forming the abrasive product.

The properties of the ensuing product can be adjusted by increasing the number of loop yarns and, correspondingly, the number of stitches with which the loops 71 are connected.

Particularly suited bindings for forming the cloth 2, for interlacing the loop yarns 70 and for interconnecting the loops 71 include pillar-, atlas-, cord-, tricot-, satin-, and inlay bindings and combinations thereof. Other bindings which are in principle suitable are defined in ISO 8388 and also comprise combined warp- and weft-knitted bindings.

An example for such a structure is shown in FIG. 2A and the corresponding yarn path notation in FIG. 2B in which black dots represent one needle bar of a double needle bar knitting machine and grey dots represent the other needle bar. As can be seen from the thread courses, the yarns 20 forming the cloth 2 are worked on one needle bar, while the loop yarns 70 are worked on both needle bars. The actual loops 71 of the loop yarns 70 are formed on the second needle bar (grey dots), however.

The cloth 2 is based on an (open) atlas binding and the interlacing of the loop yarns 70 is done by means of a pillar stitch—with the exception that a stitch is made on the second needle bar when the loops pass over the needles. Unlike the example which is shown in FIG. 1, the bottom-half arcs 76 of the individual loops are not spaced apart from one another in the course direction of the cloth, meaning that they are arranged in one and the same stitch row 22.

However, the loops 71 are also knitted in the wale direction. W of the cloth 2 so as to form rows 73 of interconnected loops 71 which extend in the wale direction W. Accordingly, also in this case, the geometric stability of the loops 71 is enhanced and the loops 71 are more readily available for fastening means such as hooks or pins as they are less prone to lay down on the cloth. The latter might occur during storing the abrasive product (either in an intermediate state or the final product state). Moreover, a lay-down of the loops 71 might be induced during manufacturing by certain process steps.

Figure 3A:
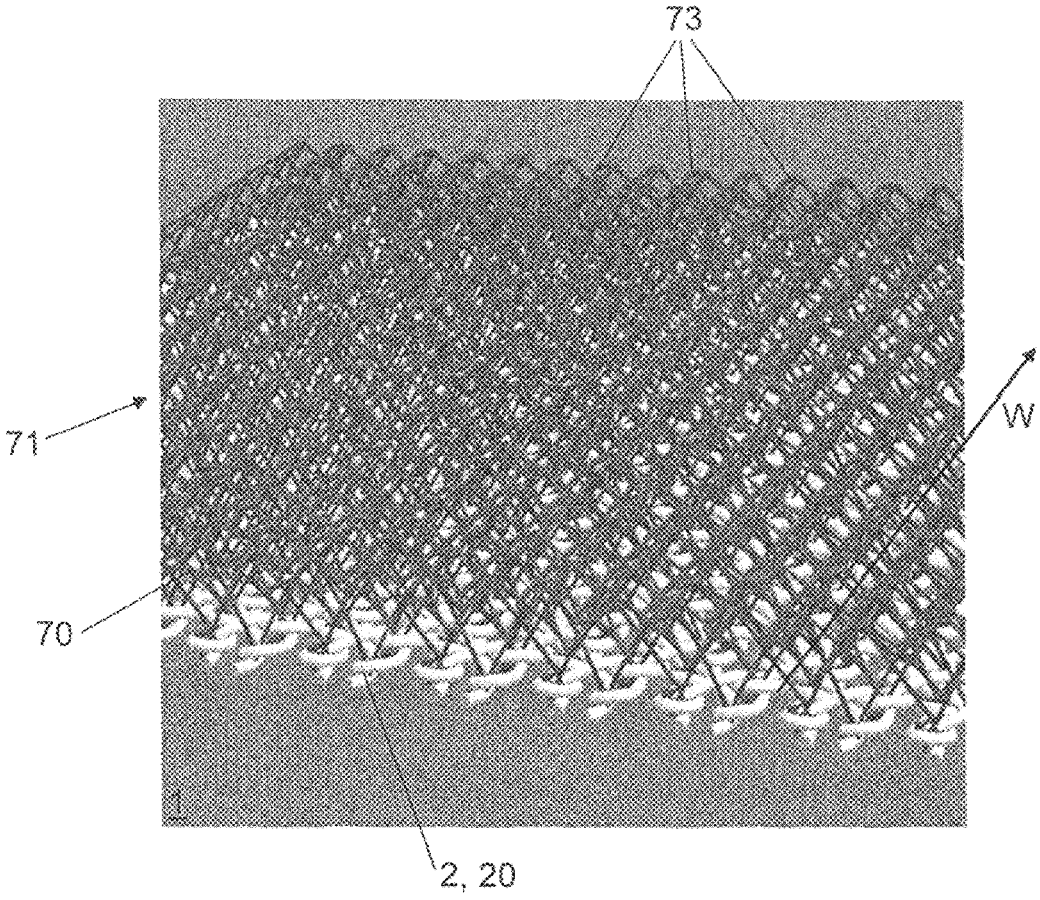
FIG. 3 shows another example for a knitting pattern for the abrasive product according to the first embodiment.
Figure 3B:
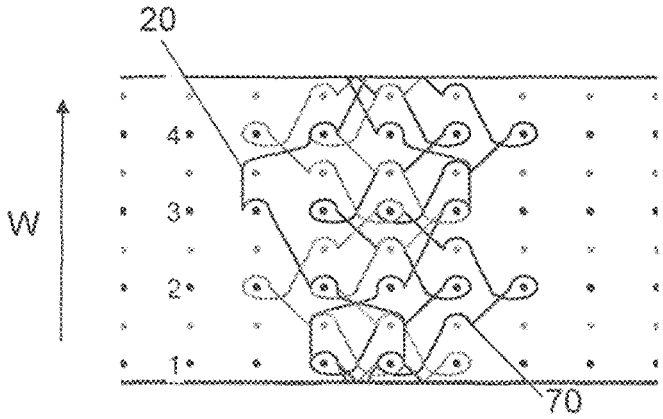

A further example for a concrete knitting pattern is shown in FIGS. 3A and 3B. As can best be seen from the yarn path notation of FIG. 3B, also the loop yarns 70 are interlaced in the form of an atlas binding.

The cloths 2 that are shown in FIGS. 1, 2 and 3 are based on structures which are highly permeable due to a number of regularly arranged through holes in the base cloth 2. The open structure enables an optimal dust removal. When dust is created during sanding, the dust can easily be removed by air streams which penetrate through cloth 2 and the loops 71.

Figure 4:
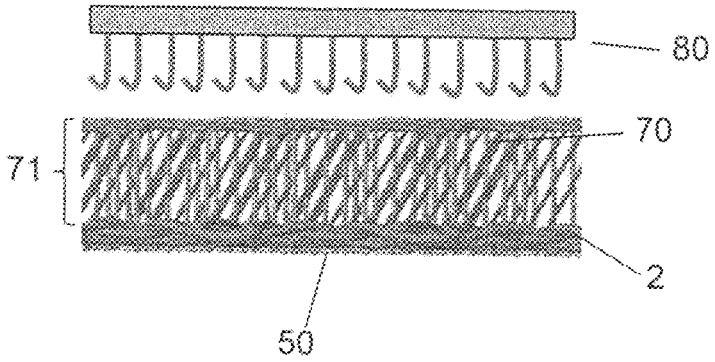
FIG. 4 illustrates the use of the abrasive product according to the first embodiment.

FIG. 4 exemplarily shows the attachment of a flexible abrasive product to corresponding engagement means of a backing pad 80 or grip surface. Due to the interconnection of the loops, the loops are more readily available for an attachment to the hooks of the backing pad 80 because they are more upright. Of note, the flexible abrasive product works equally well with other engagement means such as knobs or mushrooms and the like.

Apart from an improved attachment, the interconnected loops lead to a cushioning effect during sanding. This means that uneven spots in the cloth 2 or the abrasive area can be balanced by the soft properties of the product 1.

Figure 5:
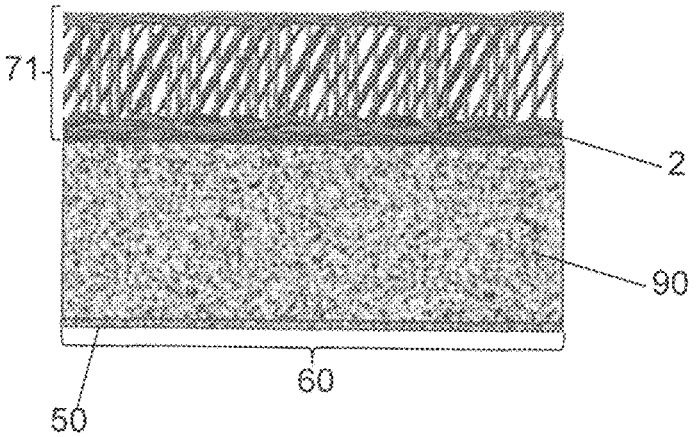
FIG. 5 illustrates a modification of the first embodiment.

In order to further promote the cushioning effect, a soft or pliable intermediate layer 90 may be arranged between the cloth 2 and the abrasive area 60, as exemplified by FIG. 5. The intermediate layer 90 may be formed of a foam or non-woven material or combinations thereof. As an alternative or additionally, the intermediate layer may also be formed of or comprise a fabric or cloth, preferably in the form of a layer.

Figure 6:
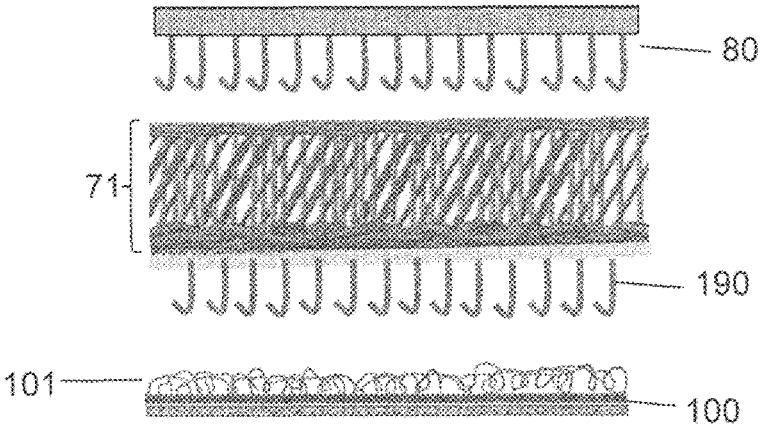
FIG. 6 is a schematic illustration of a second embodiment.

FIG. 6 schematically shows a cross-section through a flexible product 3 according to another embodiment. This embodiment differs from the previous embodiments in that the abrasive particles 50 are replaced by attachment means 190. Other features, configurations and possible modifications correspond to the ones mentioned in connection with the previous embodiments. Subsequently product 3 is also referred to as "flexible interface" 3.

The attachment means 190 are, for instance, attachment means such as hooks, knobs or mushrooms, which are suited for engaging with loops protruding from flexible abrasive articles (such as the loops 70 or, in general, loops of a Velcro®-like fastening system) or attachment means for other complementary fastening systems.

The attachment means may be provided, for instance, by laminating a suited texture of a hook-and-loop fastening system (e.g. a Velcro® fastening system) or other complementary fastening systems onto the cloth 2.

Accordingly, the flexible interface 3 can be interposed between the attachment surface 80 of a grinding machine and a suited abrasive product 100. By that, a soft and at the same time highly stable interface can be provided for conventional abrasive products. Of note, the product 3 according to this embodiment may also be combined with the pliable intermediate layer 90.

As illustrated in the examples of FIGS. 1 to 5, it is possible to use different kinds of yarns for the loop yarns 70 and the yarns 20 of the cloth 2.

This enables to use thinner yarns for the loop yarns 70 as compared to the yarns 20 of the cloth 2, for instance. While this ensures a sufficiently large area for attaching the abrasives 50 onto the cloth 2, the product as whole can still be kept substantially open which is beneficial for dust removal and attaching the product to a grinding machine. In addition, using thinner yarns for the loop yarns 70 ensures that the overall product is still soft and flexible. Moreover, this guarantees that no pronounced elevations in the cloth 2 result when the loop yarns 70 are worked on the same needle bar as the cloth 2.

In this regard, the loop yarns 70 preferably have a yarn count between 5 to 200 dtex and more preferably between 10 to 100 dtex, and even more preferably between 20 to 50 dtex.

Moreover, the loop yarns 70 may be formed of monofilament yarns while the yarns 20 forming the cloth 2 are multifilament yarns.

As mentioned, the products according to the aforementioned embodiments may comprise a coating 40 serving as a primer for applying the abrasive particles 50. In addition, the coating may be used to level any existing unevenness. Moreover, the coating also leads to a fixation of the loop yarns 70 in the cloth 2 which renders it difficult to pull out individual loops 71 from the cloth 2. The coating 40 is applied from the side of the cloth 2, where the loops do not protrude (i.e. the front side of the product).

In addition, the cloth and/or the loop yarns may comprise an impregnation for further enhancing the mechanical stability of the product.

Different types of impregnations and coatings 40 may be applied for the cloth 2. The types of resins used for impregnations and coatings may consist of phenolic, urea or latex as well as blends thereof as described in EP 0 779 851. The fabric may be coated by using roller coating, spray coating, curtain coating, slurry coating by printing methods such as screen printing or gravure rollers, transfer foil or similar methods resulting in coatings referred to as a make- and size-coat, wherein, spray and slurry coating are preferred.

Radiation curable impregnation resins such as epoxides, acrylates, or similar resins may also be applied. Also thermally curable epoxies, acrylates, isocyanides or similar resins and mixtures thereof may be utilized for the mechanical stabilization of the cloth. The resins may include fillers and additives such as surface active substances like fatty acid ethoxylates, fillers or various kinds such as fibers, aluminum trihydroxide, kaolin, calcium carbonates, talc and the like.

The coating may provide an even base layer onto which the abrasives can be applied. Thereby, the coating can level out height-irregularities and further promote an even abrasive area. To this end, the coating may be specifically treated ("flattened") before applying the abrasive particles in order to form an even surface. As described in WO 2014/037034, this can be achieved by a specific way of applying the coating, e.g., by using a coating roller. Moreover, a flattening effect can be realized by pressing a flattening device against the not yet cured coating. In addition, there is the possibility of mechanically abrading or sanding the readily applied coating such as to level out (flatten out) any existing unevenness.

The cloth 2 may furthermore be subject to any kind of surface modifications from the front side of the cloth.

The abrasive areas 60 may in the same or separate processes be strewn or coated with abrasive articles 50 such as silicon carbide, aluminum oxide of various types or mixtures thereof such as brown, pink, white, or high temperature treated species. Hereby also high performance abrasives such as ceramic coated or similar grains as well as diamonds, CBN or other particles commonly referred to as super-abrasives can be applied.

As an alternative for improving the attachment of the abrasive product to a grinding machine, it is also conceivable to use loop yarns 70 which are magnetizable and, in particular, comprise a metallic material. For this purpose, the use of yarns which possess a magnetic core or yarns based purely on magnetic materials (or materials which lead to a similar effect) is conceivable.

With that, the products 1 and 3 can be magnetized on the backside (i.e. on the side where the loops protrude) and, thus, attached to a magnetic backing plate of a grinding apparatus. The magnetic backing plate may be essentially flat, or, alternatively may comprise additional engagement means such as grip hooks in order to use mechanical and magnetic attachment simultaneously. The magnetic backing plate may comprise a permanent magnet or may rely on an electromagnetically induced effect.

In addition to that, the products 1 and 3 may comprise filler yarns 70A. The filler yarns 70A are thicker than the loop yarns 70, thereby further promoting the cushioning effect of the interconnected loops 71. The filler yarns 70A may protrude from cloth on the same sides as the loops in the form of loops or thread ends.

Moreover, the filler yarns may be hydrophilic. This is motivated by the fact that soft abrasive products are often also used in wet sanding processes which typically involve the use of liquids like water or other solvents in order to achieve a dust free sanding process and a particular surface finish. Although the three dimensional structure of interconnected loops 71 already does provide better water storing properties than single-layer products, it is sometimes desirable to further increase the water storage and water take up capacity. The filler yarns act as a filler material, which allows the abrasive product 1 to better take up water and release it over time during the sanding process.

As an alternative, also the loop yarns 70 may be hydrophilic.

One possibility for achieving a certain hydrophilicity is using texturized yarns as loop yarns and/or filler yarns.

However, for some applications also the inverse behavior could be desired, i.e. a certain degree of hydrophobicity.

In general, the loop yarns as well as the filler yarns may be treated in various ways for achieving the desired effects with respect to the water retention capability. This includes using inherently hydrophilic/hydrophobic materials or applying a suited coating to the yarns.

In order to further promote the mechanical stability of the cloth 2, it is preferable to integrate a reinforcing inlay or generally reinforcements into the product. Preferably, these inlays consist of reinforcing yarns that are worked into the cloth 2.

To this end, a pillar stitch or an inlay can be integrated as reinforcements. Preferably, the inlay-yarns or reinforcing yarns are sufficiently strong to withstand tensile forces.

Besides increasing the strength of the material, the inlay yarns or reinforcements may also be used for increasing the bulk or for achieving other desired effects.

The yarns 20 of the cloth 2, the loop yarns 70 reinforcement yarns and the filler yarns are typically texturized or flat yarns of polyester or polyamide. However, yarns based on natural fiber such as cotton, hemp or similar fiber may also be suitable. This includes in more general terms the use of so called staple fiber or multifilament yarns based on synthetic or natural fibers which can be used for the base structure or the reinforcement of the cloth. Twisted yarns being single or plied yarns can optionally also be used. Elastic yarns may be applicable in certain applications when, the cloth shall be stretched in a specific way.

The term "texturized yarn", commonly known as DTY (Drawn Texturized Yarn), is a multifilament yarn which has been treated by thermal or mechanical methods or combinations thereof in a way that the yarn filaments are coiled, crimped or looped. There are various texturizing methods which can be applied, such as air texturized, knife edge texturizing, false twist friction texturizing, staffer box texturizing or gear crimped yarn.

The term "flat yarn" is commonly known under the abbreviation FDY, which is so called Fully Drawn Yarn. Such FDY's can be of various buildup types based on mono- or multifilament. These yarns can also be either bright, semi dull or full dull in respect to their appearance, which are the most common types. However also various shapes of yarns, filaments and their cross sections are available which amongst others can be for instance of the type round, trilobal, multi-edged or of any other type of shape.

Yarns of either type, such as texturized or flat yarn, can apart from their type of texturization, or shape and appearance additionally also be twisted. "Twisting" refers to turning the yarn into two different directions which are commonly referred to as "S" and "Z" directions. These directions of twist only refer to the direction in which the yarns are twisted; so that "S" and "Z" twisted yarns resemble mirror images of each other. Such twisting of yarn has in most cases barely any technical relevance in warp knitting, but leads to different optical effects in the final cloth.

The yarns 20 forming the cloth 2, the loop yarns 70 and reinforcing yarns may be monofilament or multifilament yarns, wherein it is preferable that at least the loop yarns 70 are monofilament yarns. Due to their reduced bulk, such monofilament yarns can be more easily interlaced in the cloth 2, without too much affecting the evenness of the cloth 2.

The term "monofilament yarn" refers to a man-made, endless spun yarn which, is built up of a single filament of material. A yarn of a certain yarn count of, e.g., 20 dtex is not separated into other substructures but consists of only one filament. A multifilament yarn consequently consists of several substructures (filaments) in contrast to a monofilament yarn. Hereby, yarns can be distinguished by the number of filaments that the yarn consists of. As an example, a 20 dtex multifilament yarn can consist of for instance two or more filaments.

A "plied yarn" typically consists of multifilament yarns, which can be twisted or non-twisted yarns, texturized or non-texturized yarns, as well as intermingled or non-intermingled yarns. Whereas typically twisted yarns are not intermingled. These previously described single yarns can then in the following be joined together to form a new, thicker, yarn which is referred to as being plied. Such a plied yarn consequently consists of at least two or more single yarns which have been plied together.

The term "natural fibers" refers to fibers which have an origin in renewable sources. These refer to fiber formed materials such as cotton, hemp, wool, silk or similar materials which are directly obtained from plants or animals.

The term "man-made fiber" is referring to all other fibers than natural fibers. Man-made fibers can be synthetically produced from petrochemicals, bin-based polymers or organic raw materials. Regenerated fibers are one subgroup under man-made fibers. Those are made of natural materials like plants by going through chemical and mechanical process. These kinds of fibers are e.g. Viscose, Bamboo and Modal type yarns which are made of cellulose. Synthetic fibers can be made of petrochemicals e.g. polyester, vinyl acetate, nylon, aramid and carbon. This category also includes chemically modified fiber formed materials and fibers manufactured from polymers of bio-based building blocks like for instance, lactic acid, amino acids or propylene dioxide based materials.

Examples of other potential yarns for cloths for abrasive products include fibers of ultrahigh molecular weight polyethylene (UHMWPE), polypropylene (PP) and aramid yarns. These can be used for the base structure of the cloth or solely for the reinforcement of the material.

The yarn count of flat or texturized yarn may range from 5 to 4000 dtex, depending on the desired tensile and elongation values of the cloth as backing material, as well as the desired size of the abrasive grains or the end use of the final product. The unit "dtex" is by definition the weight in grams per 10,000 m of yarn. The typical yarn count for the cloth is between 30 to 2000 dtex and between 15 to 1000 dtex for the reinforcing yarns.

All modifications as discussed in connection with the respective Embodiments may be equally well applied in connection with the other Embodiments, if possible.

The invention claimed is:

1. Flexible abrasive product comprising:

a knitted cloth on a first side of the flexible abrasive product, the knitted cloth having a wale direction and a course direction;

grinding agents applied on a second side of the flexible abrasive product facing the first side;

a plurality of loops protruding from the knitted cloth and from the first side, each loop being formed by a pair of bottom-half arcs connected by a protruding head and the loops being arranged in rows extending in the wale direction of the knitted cloth; wherein the bottom-half arcs are interlaced in the knitted cloth, the plurality of loops or protruding heads each span a stitch row in the course direction, and the protruding heads of the loops are interconnected with one another outside of the knitted cloth so as to form rows of interconnected loops, which rows extend in the wale direction of the knitted cloth.

2. Flexible abrasive product according to claim 1, wherein the bottom-half arcs of each loop are at least spaced by two stitch rows of the knitted cloth.

3. Flexible abrasive product according to claim 1, wherein the protruding heads alternatingly span one stitch row in the course direction of the knitted cloth.

4. Flexible abrasive product according to claim 1, wherein the protruding heads of the loops are interconnected by being knitted to one another in the wale direction of the knitted cloth by chaining protruding heads which succeed one another in the wale direction of the knitted cloth.

5. Flexible abrasive product according to claim 1, wherein the protruding heads are interconnected by threading the protruding head of one loop through the protruding head of another loop which precedes the one loop in the wale direction of the knitted cloth.

6. Flexible abrasive product according to claim 1, wherein the protruding head of each loop comprises two leg portions respectively connecting to the bottom half arcs and a top arc connecting the two leg portions, wherein the leg portions extend in a direction away from the knitted cloth and the first side, the top arc is arranged essentially horizontally to the knitted cloth, and the protruding heads of the loops are connected to one another at their top arcs.

7. Flexible abrasive product according to claim 1, wherein the protruding head of each loop has a contour length of 4 mm to 500 mm.

8. Flexible abrasive product according to claim 1, wherein the loops are formed by loop yarns which are interlaced in the knitted cloth.

9. Flexible abrasive product according to claim 8, wherein the loop yarns are man-made or natural fibers comprising flat yarns, texturized yarns, magnetizable, metallic or hydrophilic yarns and/or combinations thereof.

10. Flexible abrasive product according to claim 8, wherein the loop yarns are warp- or weft-knitted into the knitted cloth in the form of an atlas, tricot, pillar, or cord binding or combinations thereof.

11. Flexible abrasive product according to claim 8, wherein the loop yarns are monofilament and/or multifilament yarns and combinations thereof.

12. Flexible abrasive product according to claim 1, wherein the knitted cloth is warp- or weft-knitted in the form of an atlas, tricot or cord binding.

13. Flexible abrasive product according to claim 1, wherein the knitted cloth further comprises a plurality of regularly arranged openings in the form of through holes.

14. Flexible abrasive product according to claim 1, further comprising a pliable intermediate layer which is arranged between the grinding agents and the knitted cloth (2), the pliable intermediate layer being formed of a non-woven material, a foam material, a fabric material or combinations thereof.

15. Flexible abrasive product comprising:

a knitted cloth on a first side of the flexible abrasive product;

grinding agents applied on a second side of the flexible abrasive product facing the first side;

a plurality of loops protruding from the knitted cloth and from the first side, each loop being formed by a pair of bottom-half arcs connected by a protruding head and the loops being arranged in rows extending in the wale direction of the knitted cloth; wherein the bottom-half arcs are interlaced in the knitted cloth, and the protruding heads of the loops are interconnected with one another outside of the knitted cloth so as to form rows of interconnected loops, which rows extend in the wale direction of the knitted cloth; and filler yarns protruding from the first side, wherein the filler yarns are texturized or hydrophilic yarns, and the filler yarns protrude in the form of loops or thread ends.

16. Flexible interface for abrasive products; the flexible interface comprising:

a knitted cloth on a first side of the flexible interface, the knitted cloth having a wale direction and a course direction;

attachment means arranged on a second side of the flexible interface facing the first side, the attachment means being configured to be engageable to abrasive products;

a plurality of loops protruding from the first side and from the knitted cloth, each loop being formed by a pair of bottom-half arcs connected by a protruding head and the loops being arranged in rows extending in the wale direction of the knitted cloth; wherein the bottom-half arcs are interlaced in the knitted cloth, the plurality of loops or protruding heads each span a stitch row in the course direction, and the protruding heads of the loops are interconnected with one another outside of the knitted cloth so as to form rows of interconnected loops, which rows extend in the wale direction of the knitted cloth.

17. Flexible interface according to claim 16, wherein the bottom-half arcs of each loop are at least spaced by two stitch rows of the knitted cloth.

18. Flexible interface according to claim 16, wherein the protruding heads alternatingly span one stitch row in the course direction of the knitted cloth.

19. Flexible interface according to claim 16, wherein the protruding heads of the loops are interconnected by being knitted to one another in the wale direction of the knitted cloth by chaining protruding heads which succeed one another in the wale direction of the knitted cloth.

20. Flexible interface according to claim 16, wherein the protruding heads are interconnected by threading the protruding head of one loop through the protruding head of another loop which precedes the one loop in the wale direction of the knitted cloth.

* * * * *